United States Patent [19]

Michaelsen et al.

[11] Patent Number: 4,606,088

[45] Date of Patent: Aug. 19, 1986

[54] FURNITURE CUSHION

[75] Inventors: Jan Michaelsen, Them; Peer Herbsleb, Silkeborg, both of Denmark

[73] Assignee: Jørck & Larsen A/S, Them, Denmark

[21] Appl. No.: 662,418

[22] PCT Filed: Jan. 27, 1984

[86] PCT No.: PCT/DK84/00007

§ 371 Date: Sep. 25, 1984

§ 102(e) Date: Sep. 25, 1984

[87] PCT Pub. No.: WO84/02897

PCT Pub. Date: Aug. 2, 1984

[30] Foreign Application Priority Data

Jan. 27, 1983 [DK] Denmark ..... 312/83

[51] Int. Cl.[4] ..... A47G 9/00; A47C 27/22

[52] U.S. Cl. ..... 5/434; 5/481; 5/490

[58] Field of Search ..... 5/434, 436, 448, 481, 5/490

[56] References Cited

U.S. PATENT DOCUMENTS

| | | | |
|---|---|---|---|
| 2,956,291 | 10/1960 | Hauptman | 5/434 |
| 3,109,182 | 11/1963 | Doak | 5/434 |
| 3,162,868 | 12/1964 | Cramer | 5/490 |
| 3,283,346 | 11/1966 | Marsh et al. | 5/481 |
| 3,403,414 | 10/1968 | Unger | 5/481 |
| 4,080,675 | 3/1978 | Kanowsky et al. | 5/481 |
| 4,184,237 | 1/1980 | Blankenship | 5/481 |
| 4,207,636 | 6/1980 | Ceriani | 5/434 |

FOREIGN PATENT DOCUMENTS

| | | | |
|---|---|---|---|
| 2221011 | 10/1974 | France | 5/434 |
| 546874 | 8/1942 | United Kingdom | 5/481 |

*Primary Examiner*—Alexander Grosz

*Attorney, Agent, or Firm*—Thomas R. Vigil

[57] ABSTRACT

A cushion or pillow for use by making upholstered furniture comprises a generally block- or plate-shaped foam core (2) and a fibrous stuffing material (6) which surrounds the core. The stuffing material (6) includes at least one layer or web of a cable fiber material, the layer being dimensioned and retained to completely enclose the core. The long and generally uniformly oriented cable fibers or filaments are retained and the stuffing material does not include free or loose fibers. Accordingly, it is not necessary to make specific demands with respect to the tightness of cover fabrics, since there are no loose fibers which are able to penetrate the cover. The fact that the long fibers or filaments are continuous has also the effect that the fibers or filaments are not able to lump or become firmly bonded together and, thereby, the cushion can be cleaned by usual washing and drying.

8 Claims, 3 Drawing Figures

FURNITURE CUSHION

Figure 1:
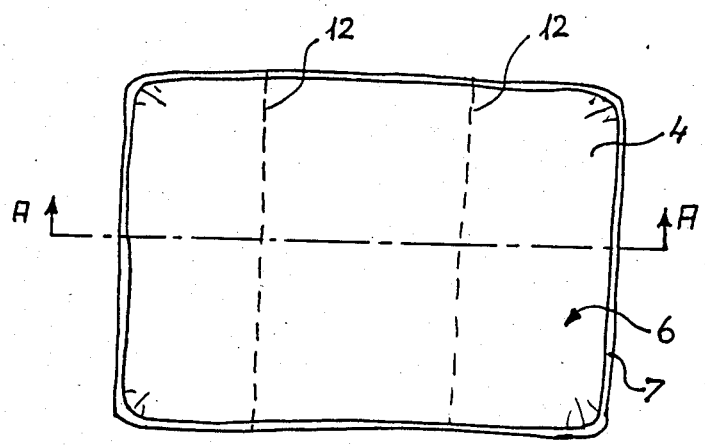

The present invention relates to a cushion or pillow, in particular for making upholstered furniture and comprising a generally block- or plate-shaped foam core and a fibrous stuffing material surrounding the core.

Cushions or pillows of the above type are known in the art and are usually sold to furniture manufactures as an intermediate article of manufacture for making upholstered furniture.

Examples of such cushions are disclosed in U.S. Pat. No. 3,283,346. The core is interposed between two batts of fibers which are generally coextensive with the core and each batt comprises loosely matted fibers. The batts and the core therebetween are disposed within a cover formed in two parts, one for each major side of the cushion, and each cover part has marginal edge portions which extend beyond the peripheral edges of the batts and core. These marginal edge portions are folded over each other in overlapping relation, and adhesive bonds are made partly between the overlapping edge portions and partly between the edge portions and the peripheral edges of the core.

This method of manufacture is complicated and, moreover, the cushions made thereby have several drawbacks. Thus, the relatively loose fibers in the two batts, which serve as stuffing material, are able to penetrate through the outer cover fabric if a relatively tight cover fabric is not used. Moreover, the stuffing material will eventually be "worn out" due to mechanical influences or stresses. This wear shows up by the cushion being thinner and harder at areas where it has been subjected to mechanical influences. The reason therefore is that the relatively short fibers, of which the stuffing material is constructed, will gradually be very firmly or permanently bonded into each other due to the mechanical influences, and this results in a harder and thinner stuffing material. Finally, the cushion must be cleaned by dry cleaning, since the mechanical influences, which the cushion is subjected to during usual washing and drying, will cause the fibrous stuffing material to lump or bond together which results in a substantial deterioration of the cushion.

The cushion or pillow according to the invention is characterized in that the stuffing material comprises at least one web or layer of a cable fiber material, the web being dimensioned and retained to completely enclose the core.

Cable fiber material is available in the shape of bundles of parallel and very long (in principle indefinitely long) fibers or filaments and such bundles can be spread out mechanically to define webs or layers wherein the long fibers or filaments still extend generally uniformly oriented and continuously through a cut web piece.

In accordance with the invention, the foam core is completely enclosed in one or more such web pieces or layers of cable fiber material, the web or webs of stuffing material being so dimensioned relative to the core that marginal portions of the stuffing material can be folded about the edges of the core in such a manner that the core is completely enclosed in the stuffing material. In the stuffing material there are no loose or free fibers which would possibly be able to penetrate through a cover and, accordingly, it is not necessary to make specific demands or limitations with respect to the tightness of the cover fabric.

Moreover, the long and continuous fibers or filaments in the stuffing material are not able to lump or bond together to a greater extent than the original shape of the stuffing material, and hence of the cushion, can be recovered by shaking. The fact that the fibers are not able to lump or bond firmly together has also the effect that cushions embodying the invention can be cleaned by usual washing and drying.

In order to stabilize or retain the stuffing material, it is not necessary to adhesively attach the stuffing material to the core, and suitable joints between the marginal portions of the stuffing material have proven to be sufficient. Such joints may be stitchings or weldings which are appropriately distributed around the core along the periphery thereof.

As an alternative, or as a supplement to retaining the stuffing material around the core by means of joints between the marginal portions of the stuffing material, the stuffing material may also be retained to enclose the core by means of a relatively tight fitting cover. Such a cover may have a rather open structure and may even have an open net-like structure.

In a specific embodiment, the stuffing material includes two sheets of fiber cloth which may be of woven or non-woven material with the web or layer of cable fiber material as a filler therebetween. With a fibrous stuffing material which is made in this manner, the long cable fibers or filaments are stabilized more effectively, in particular if the two sheets of fiber cloth and the filler of cable fiber material therebetween are fixed relative to each other such as is preferred. Due to the generally uniformly oriented fibers or filaments in the stuffing of cable fiber material, such fixings can appropriately be performed by means of weldings or stichings which may define tracks extending transversely of the cable fibers, or may alternatively define suitable patterns.

Figure 2:
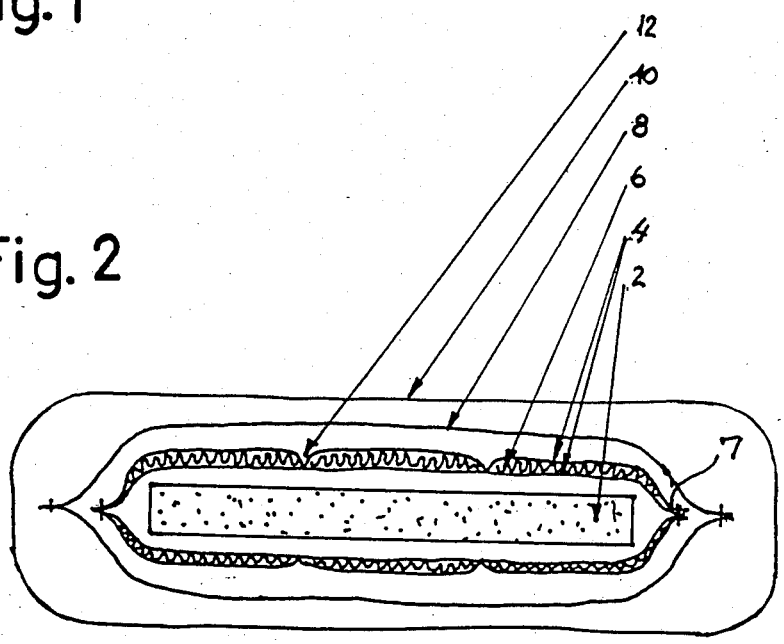
Figure 3:
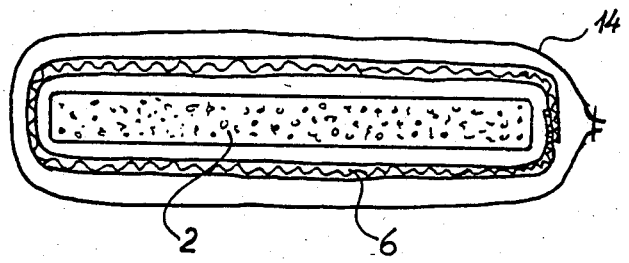

In the following, the invention will be explained in further detail and with references being made to the drawings, wherein FIG. 1 is a schematic plan view of a cushion or pillow embodying the invention;

FIG. 2 is a schematic sectional view corresponding to A—A in FIG. 1, but wherein the individual component parts are shown excessively separated for the sake of clearness, and wherein the cushion is also illustrated as enclosed in a protective cover and in an outer cover of fabric; and FIG. 3 is a schematic sectional view similar to FIG. 2, but illustrating a modified cushion or pillow embodying the invention.

FIG. 1 of the drawings schematically illustrates an embodiment of the cushion or pillow according to the invention which is suitable as an intermediate article of manufacture for making upholstered furniture. As shown in FIG. 2, the cushion includes a foam core 2 which is enclosed or enveloped in a fibrous stuffing material. The stuffing material includes a layer 6 of cable fiber material wherein the individual fibers or filaments extend generally uniformly oriented and continuously through the layer.

The general or overall direction of orientation of the filaments may e.g. be from the left to the right in FIGS. 1 and 2.

In the embodiment illustrated, the layer or web 6 of cable fiber is made of two generally coextensive single layers, one at each of the major sides of the core 2. Each of the layers has a contour and dimensions which are sufficient to permit that the two single layers can be joined together along the peripheries thereof and thereby completely enclose the core. The joints which are indicated at 7 may be weldings or stitchings and preferably the layers 6 of cable fibers fit rather tightly around the core 2.

Regardless of the general direction of orientation of the cable fibers in layer 6, the joint 7 will fix the free filament ends and the filaments will extend continuously across the two major sides of the cushion. Thereby the filaments are fixed to such an extent that they are not able to lump or to become firmly and unbreakably bonded together, e.g. because of mechanical influences or stresses or washing.

As an alternative to the embodiment illustrated with two layers 6 of cable fiber material, the core 2 may also be enclosed in one single layer or web which is folded or wrapped around one edge of the core, e.g. the left edge in FIG. 2, and wherein joints corresponding to the joints 7 are made along the remaining part of the periphery of the core.

If necessary, or appropriate, the fibrous stuffing material may also be made of several superposed single layers or webs on each major side of the core.

In embodiments as those discussed above, the long filaments or cable fibers in the layer or the layers 6 of stuffing material may be fixed sufficiently by the peripheral joints 7, and the core 2 with its enclosing stuffing material can be sold and distributed as an intermediate article of manufacture or semi-product for making upholstered furniture. In such cases, the furniture manufacturers may themselves mount the desired covers and in this connection it is not necessary to use fabrics which are tight and impermeable, since the fiber stuffing material does not include loose fibers which are able to penetrate through the cover.

In order to further fix or stabilize the layer or layers 6 of fibrous stuffing material, the cable fiber material may appropriately be covered on both major sides with a relatively thin layer or sheet 4 of fiber cloth which may be woven or non-woven. The stabilizing of fibers or filaments may also be further improved by fixing the two sheets 4 and the layer 6 of cable fiber material therebetween relative to each other. This may be performed by means of weldings or lines of stitching 12 which may be arranged in specific patterns and preferably extend across or transversely of the overall direction of orientation of the cable fibers.

Moreover, a protective cover may be mounted as indicated at 8 in FIG. 2, and cushions embodying the invention may possibly also be made with an outer cover of fabric as indicated schematically at 10 in FIG. 2. However, as previously mentioned, the normal procedure will be that the cushion is made and delivered to furniture manufacturers without an outer cover 12 and possibly also without a protective cover 8. The furniture manufacturers may then mount desired covers in a conventional manner, However, a cover corresponding to the protective cover 8 in FIG. 2 is also able to perform or assist in the retainment of the stuffing material around the core. FIG. 3 illustrates schematically a section corresponding to that of FIG. 2, but through an embodiment wherein the stuffing material is retained only by means of a cover 14 which fits relatively tightly around the stuffing material and the core enclosed therein. The stuffing material is a layer or web which has been folded or wrapped around an edge of the core. Along the remaining parts of the periphery of the core, the stuffing material has marginal portions which extend beyond the edges or periphery of the core. These marginal portions are folded about the edges of the core and the cover 14 is sufficiently tight-fitting to retain the marginal portions of the stuffing material in the folded condition.

The free edges of the folded marginal portions of the stuffing material may abut or overlap as indicated in FIG. 3.

In particular if the stuffing material comprises two sheets of fiber cloth with the cable fiber material disposed as a filler therebetween, as described in connection with FIG. 2, it is sufficient if the cover 14 has an open, e.g. net-like structure. Fixings corresponding to the lines of stitching or welding 12 in FIGS. 1 and 2, may appropirately be made along the free edges of the stuffing material and at least along such free edges which intersect the general direction of orientation for the fibers or filaments in the cable fiber material.

Embodiments as that schematically illustrated in FIG. 3 are preferred because they permit a rational manufacture. However, it should be understood that stuffing materials in the shape of two coextensive layers (FIG. 2) may also be retained by means of a cover corresponding to cover 14, i.e. without marginal joints corresponding to joints 7 in FIGS. 1 and 2.

As previously indicated, the retainment of the stuffing material to enclose the core may also be performed by means of combinations of marginal joints corresponding to joints 7 in FIGS. 1 and 2, and a cover corresponding to cover 14 in FIG. 3.

Contour, shape and size, and the thickness of the individual component parts or layers in a cushion according to the invention will of course depend on the contemplated final use of the cushion. It is also to be understood that although the invention has been described above with reference to the generally rightangular shapes illustrated, the invention is equally applicable to cushions or pillows of other contours or shapes such as round and oval. However, the thickness of the stuffing material in free, uncompressed condition may typically be 20–30 mm and the thickness of the foam core may typically be 10–100 mm.

Finally a cushion or pillow embodying the invention may also be designed as an independent or separate seating and/or lying furniture.

We claim:

1. A washable, form retaining cushion or pillow, in particular for making upholstered furniture and comprising a generally block- or plate-shaped foam core and a tight casing of a fibrous stuffing material surrounding the core, characterized in that said stuffing material comprises at least one continuous layer of long, continuous, and generally uniformly oriented cable fibers without free or loose fibers therein, said layer being dimensioned to completely enclose the core.

2. A cushion as defined in claim 1, characterized in that said stuffing material is retained to enclose the core by means of a relatively tight-fitting net-like cover.

3. A cushion as defined in claim 1 or 2, characterized in that said stuffing material comprises two sheets of fiber cloth with said web of cable fiber material as a filler therebetween.

4. A cushion as defined in claim 3, characterized in that said two sheets of fiber cloth and said filler of cable fiber material are fixed together.

5. A cushion as defined in claim 4, characterized in that said two sheets of fiber cloth and said filler of cable fiber therebetween are fixed together by stitchings.

6. A cushion as defined in claim 4, characterized in that said two sheets of fiber cloth and said filler of cable fiber therebetween are fixed together by weldings.

7. A cushion as defined in claim 4, 5 or 6, characterized in that said fixings define tracks which extend transversely of said cable fibers.

8. A cushion as defined in claim 4, 5 or 6, characterized in that said fixings define patterns.

* * * * *